US009666387B2

(12) United States Patent
Sheng

(10) Patent No.: US 9,666,387 B2
(45) Date of Patent: May 30, 2017

(54) WATERPROOF BUTTON STRUCTURE

(71) Applicant: Getac Technology Corporation, Hsinchu County (TW)

(72) Inventor: Yen-Long Sheng, Taipei (TW)

(73) Assignee: GETAC TECHNOLOGY CORPORATION, Hsinchu County (TW)

( * ) Notice: Subject to any disclaimer, the term of this patent is extended or adjusted under 35 U.S.C. 154(b) by 204 days.

(21) Appl. No.: 14/615,901

(22) Filed: Feb. 6, 2015

(65) Prior Publication Data

US 2016/0233034 A1 Aug. 11, 2016

(51) Int. Cl.
*H01H 13/06* (2006.01)

(52) U.S. Cl.
CPC ..... *H01H 13/063* (2013.01); *H01H 2221/026* (2013.01); *H01H 2223/002* (2013.01)

(58) Field of Classification Search
CPC ..... H01H 13/06; H01H 13/063; H01H 13/14; H01H 9/04; H01H 2009/048; H01H 3/12; H01H 3/00; H01H 9/00; H01H 9/02; H01H 9/041; H01H 13/50; H01H 13/00; H01H 13/02; H01H 13/54; H01H 2003/12; H01H 2235/004; G04B 29/00
USPC ..... 200/302.2; 368/289, 290, 291, 292, 319
See application file for complete search history.

(56) References Cited

U.S. PATENT DOCUMENTS 4,386,254 A * 5/1983 Eberhardt ..... H01H 23/06 200/302.1
4,417,113 A * 11/1983 Saito ..... G04B 37/106 200/302.2
6,046,905 A * 4/2000 Nelson ..... G06F 1/184 257/E23.086
6,614,364 B1 * 9/2003 Yeh ..... H01H 13/702 200/5 R
2006/0113173 A1 * 6/2006 Matsumoto ..... G03B 17/08 200/302.2

* cited by examiner

*Primary Examiner* — Anthony R. Jimenez
(74) *Attorney, Agent, or Firm* — Locke Lord LLP; Tim Tingkang Xia, Esq.

(57) ABSTRACT

A waterproof button structure includes a housing, a button cap, a plurality of waterproof elements and a fastening member. The housing has a first surface and a second surface, and is formed with a pair of through holes and a groove. The button cap is capable of correspondingly moving a long a normal direction of the first surface of the housing, and includes a pair of button shafts respectively inserted in the pair of through holes. The waterproof elements are disposed between the button shafts and the through holes. The fastening member is assembled to the button shafts and is disposed correspondingly to the second surface. The fastening member includes a bent portion. The bent portion is disposed in protrusion towards the groove and includes a protrusion. When the button cap is pressed, the protrusion is abutted against a press switch.

15 Claims, 9 Drawing Sheets

WATERPROOF BUTTON STRUCTURE

BACKGROUND OF THE INVENTION

Field of the Invention

The present invention relates to a button structure, and more particularly to a waterproof button structure having a reduced size.

Description of the Prior Art

Accompanied by the progressing technologies, development trends of electronic products are aimed at being multifunctional as well as having a fast operation speed and a small size. With the availability of these high-tech electronic products, the lifestyle of modern people is correspondingly changed, as conveniences brought for the people by these high-tech products are seen in learning, work and leisure aspects. Among the high-tech products, smart phones are one of the most prevalent. Apart from smart phones, associated manufacturers have also released the so-called wearable devices such as smartwatches.

The volume of smartwatches is smaller than that of smart phones, and so smartwatches correspondingly carry a battery having a smaller volume as well. Such feature may provide an inadequate battery capacity that cannot be used for an extended period of time. FIG. 1 shows a section view of a conventional waterproof button structure. The conventional mechanical button includes a housing 10, a button cap 12 having a single shaft 14, two springs 16 disposed at two sides of the button cap 12, and a touch control switch 20 (e.g., a switch in a component in an electronic watch). The button cap 12 having the single shaft 14 is penetrated through the housing 10, and limits a displacement amount of the button cap 12 using a bolt 18. With the configuration of the conventional mechanical button structure shown in FIG. 1, an external pressing force from a user poses a one-directional force on the button cap 12. Thus, not only the button cap 12 is liable to wavering due to the potential unevenly distributed force, but also a waterproof ring 22 disposed on the single shaft 14 is likely to wear out to cause leakage of incoming water. Further, such mechanical button does not conform to the miniaturization trend of electronic devices, and more particularly does not satisfy requirements as a button of a wearable device.

Therefore, it is vital task of associated industrialists to provide a solution that solves issues of wear of a waterproof element and a sizable volume of a conventional mechanical button structure.

SUMMARY OF THE INVENTION

It is an object of the present invention to provide a waterproof button structure having miniscule button structure size for a lighter and smaller product.

It is another object of the present invention to provide a waterproof button structure applicable to a wearable device.

To achieve the above objects, the present invention provides a waterproof button structure. The waterproof button structure includes a housing, a button cap, a plurality of waterproof elements and a fastening member. The housing has a first surface and a second surface, and is formed with a pair of through holes and a groove. The groove is provided at the second surface and is formed between the pair of through holes. The button cap is capable of moving along a normal direction of the first surface of the housing. The button cap is provided with a pair of button shafts, which are respectively inserted in the pair of through holes. The waterproof elements are provided between the button shafts and the through holes. The fastening member is assembled to the pair of button shafts and is disposed correspondingly to the second surface. The fastening member includes a bent portion. The bent portion is disposed in protrusion towards the groove, and includes a protrusion. When the button cap is pressed, the protrusion is abutted against a press switch.

Preferably, a protruding height of the protrusion towards the press switch is smaller than a height of the button shafts towards the press switch. Thus, the size of the press switch can be appropriately increased to further increase the battery capacity of the press switch.

Preferably, the button structure further includes an elastic element disposed between the button cap and the housing. The button cap further includes a first abutting recess located between the two button shafts. A second abutting recess is provided at the first surface of the housing, located between the two through holes, and disposed correspondingly to the first abutting recess. Two ends of the elastic element are positioned in the first abutting recess and the second abutting recess, respectively, to allow the button cap to restore to an original position.

The present invention provides following effects. In the present invention, the groove is provided at the second surface of the housing, and the bent portion of the fastening member is disposed in protrusion towards the groove. Accordingly, compared to a conventional solution, the present invention reduces the size by 1.06 mm to further reduce the size of the button structure, thus yielding reduced overall size by 3.2%. Further, using the two button shafts 210 correspondingly disposed at the button cap 200, a pressing force is evenly distributed, thereby eliminating issues of wear at one side of a waterproof element caused by an unevenly distributed force and likely leakage of incoming water into the structure.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF THE EMBODIMENTS

The present invention provides a waterproof button structure capable of preventing one side of a waterproof element from wear. In a preferred embodiment, the waterproof button structure is applied to a wearable device, such as a smartwatch, a smart bracelet or another type of smart device. In other embodiments, the waterproof button structure of the present invention may also be applied to a common device having a button structure. Details and technical contents of the present invention are given below with reference to the accompanying drawings. It should be noted that these drawings are reference for illustrating the present invention and are not to be construed as limitations to the present invention.

Figure 1:
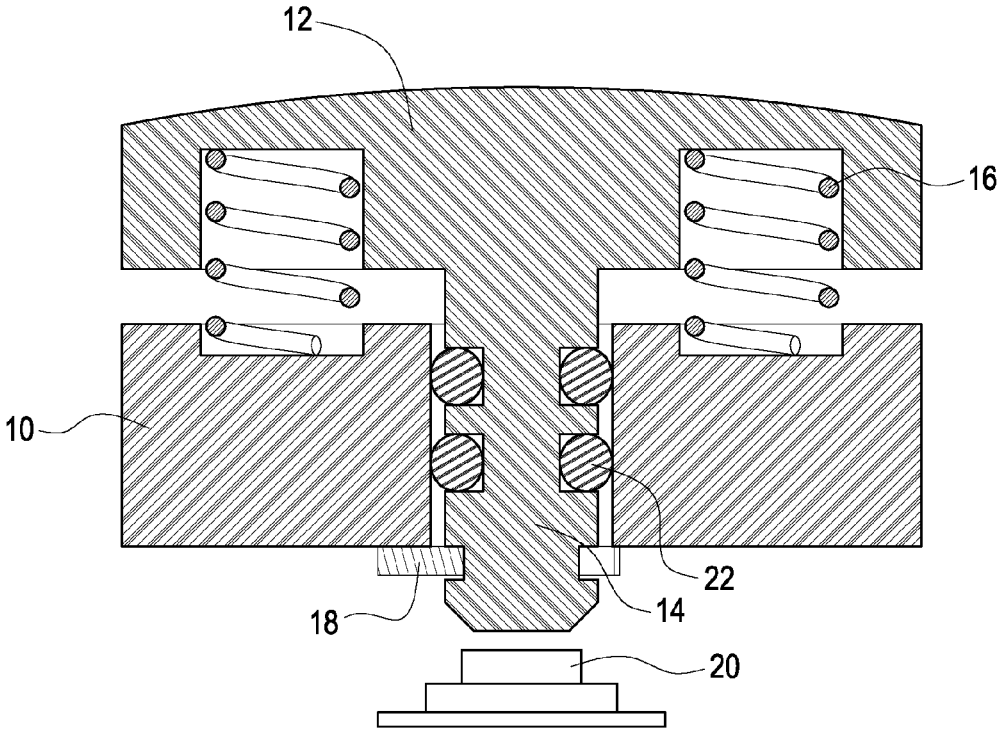
FIG. 1 is a section view of a conventional waterproof button structure.
Figure 2:
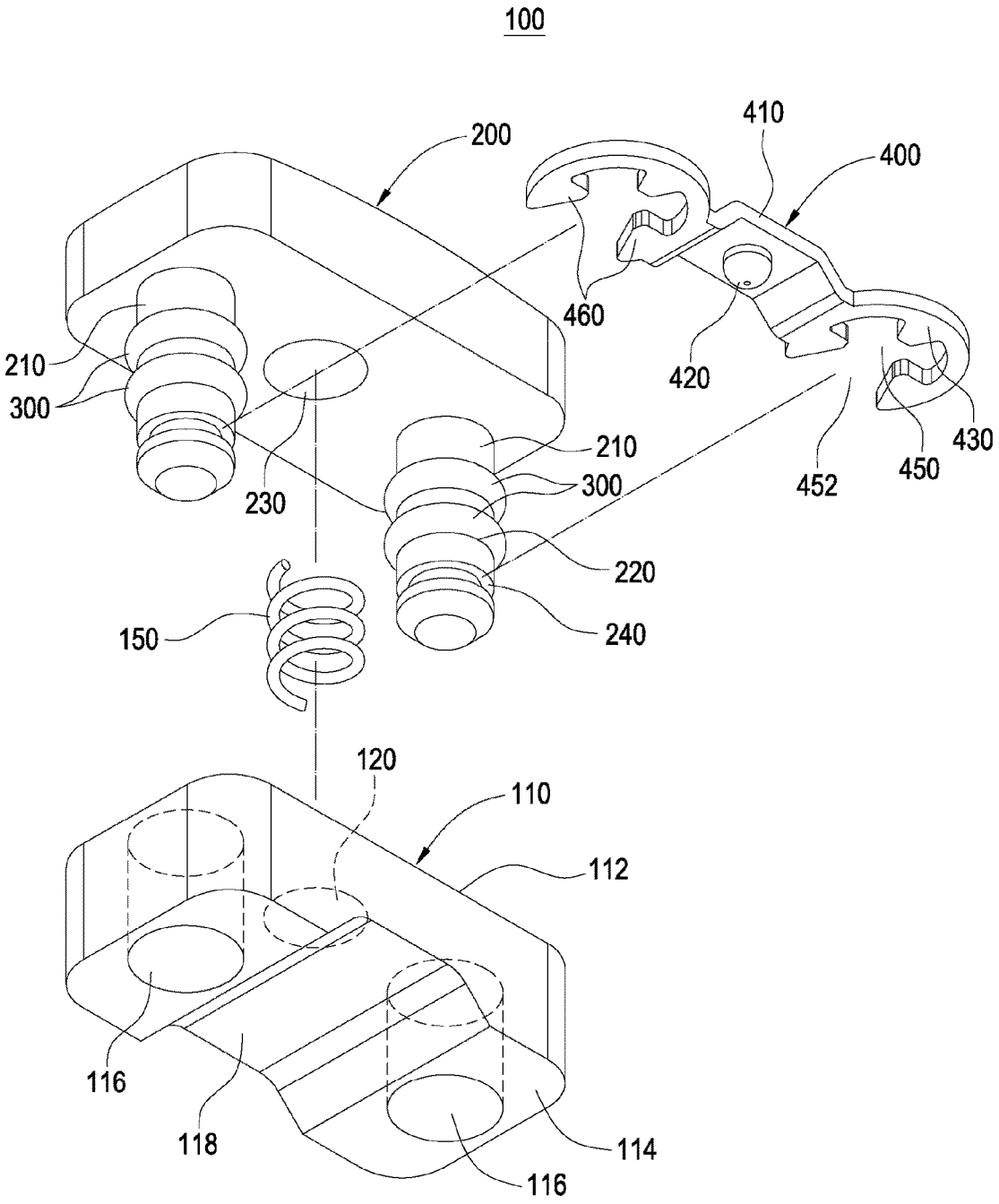
FIG. 2 is an exploded view according to a first embodiment of the present invention.
Figure 3:
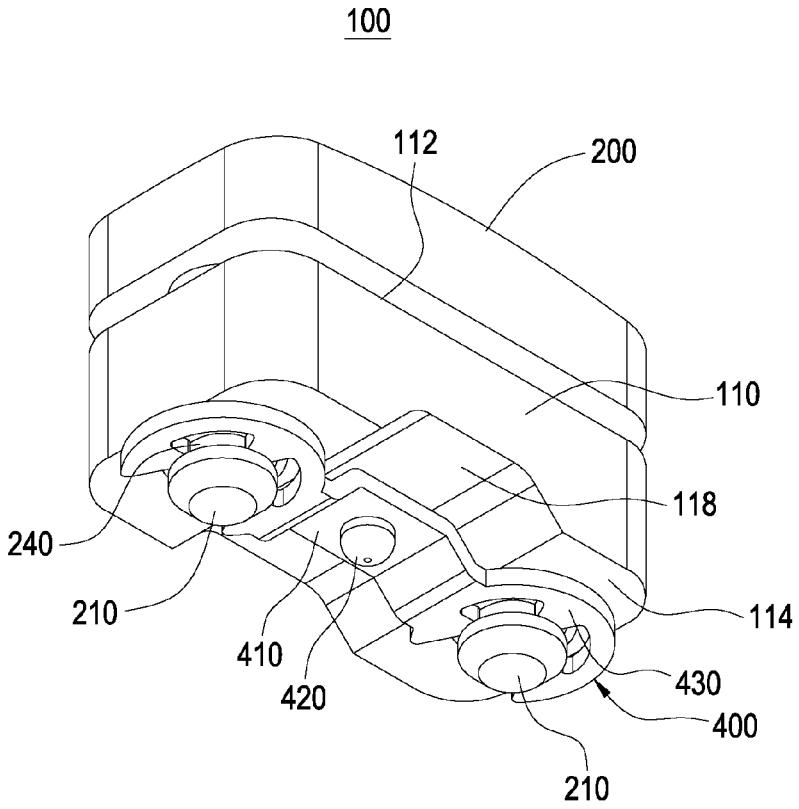
FIG. 3 is a perspective view according to the first embodiment of the present invention.
Figure 4:
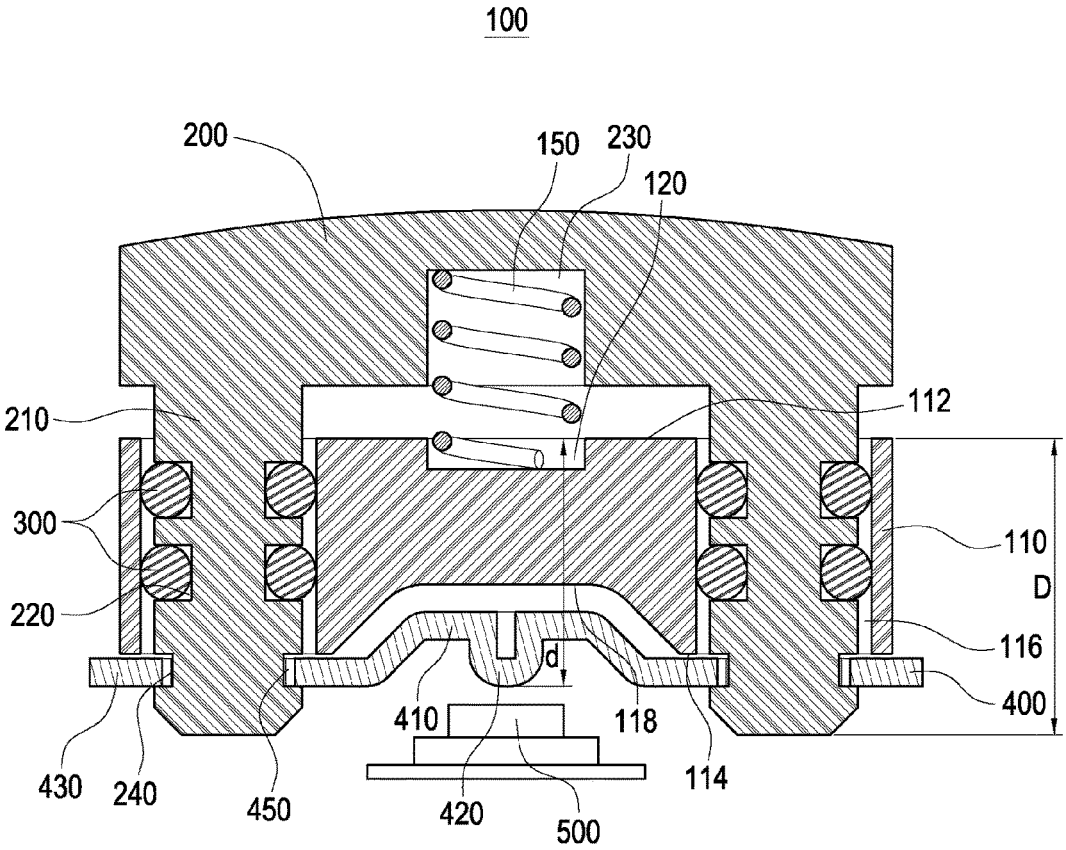
FIG. 4 is a section view according to the first embodiment of the present invention.

FIG. 2 to FIG. 4 are an exploded view, a perspective view and a section view according to a first embodiment of the present invention. As shown in FIG. 2, a waterproof button structure 100 includes a housing 110, a button cap 200, a plurality of waterproof elements 300, and a fastening member 400. In general, the housing 110 and button cap 200 are insulation materials, e.g., plastic, plastic steel, or other appropriate materials. The housing 110 has a first surface 112, and a second surface 114 opposite the first surface 112. The housing 110 is formed with a pair of through holes 116 and a groove 118. The groove 118 is provided at the second surface 114 and is formed between the pair of through holes 116. The button cap 200 is capable of correspondingly moving along a normal direction of the first surface 112 of the housing 110, i.e., a direction perpendicular to the first surface 112 of the housing 110. The button cap 200 includes a pair of button shafts 210. Further, the button cap 200 and the pair of button shafts 210 maybe a formed integral, and the pair of button shafts 210 are inserted in the pair of through holes 116, respectively.

The waterproof elements 300 are disposed between the button shafts 210 and the through holes 116. Further, in the embodiment shown in FIG. 2 to FIG. 4, each of the button shafts 210 further includes a plurality of encircling channels 220. Preferably, the waterproof elements 300 are disposed in the encircling channels 220, and are waterproof rubber rings. In other embodiments, the waterproof elements 300 may also be waterproof elements such waterproof plastic strips. As shown in FIG. 2, the number of the waterproof elements 300 disposed correspondingly to the encircling channels 220 may be 2, or other values depending on actual requirements. Further, the waterproof elements 300 are soft plastic materials, and may have an outer diameter greater than or equal to an inner diameter of the through holes 116, so as to block water vapor from entering the device via gaps between the waterproof elements 300 and the through holes 116.

Referring to FIG. 4, the button structure 100 further includes an elastic element 150, which is preferably a spring or other similar elements. The elastic element 150 is disposed between the button cap 200 and the housing 110. The button cap 200 further includes a first abutting recess 230, which is located between the two button shafts 210. A second abutting recess 120 is provided at the first surface 112 of the housing 110. The second abutting recess 120 is provided between the two through holes 116, and is disposed correspondingly to the first abutting recess 230. Two ends of the elastic element 150 are positioned in the first abutting recess 230 and the second abutting recess 120, respectively, such that the button cap 200 is allowed to restore to an original position after being pressed by an external force (e.g., an external processing force from a user).

As shown in FIG. 2 and FIG. 4, the fastening member 400 is assembled to the pair of button shafts 210 and is disposed correspondingly to the second surface 114. The fastening member 400 includes a bent portion 410. The bent portion 410 is disposed in protrusion towards the groove 118, and includes a protrusion 420. According to a technical characteristic of the present invention, a protruding height d of the protrusion 420 from the first surface 112 towards a press switch 500 is smaller than a height D of the button shafts 210 from the first surface 112 towards the press switch 500. Thus, the size of the press switch 500 may be appropriately enlarged to increase the battery capacity of the press switch 500. The fastening member 400 made of metal further includes a flat portion 430 and a fastening hole 450. The flat portion 430 connects two ends of the bent portion 410, and the fastening hole 450 is formed in the flat portion 430. Further, horizontal surfaces of the two flat portions 430 are different from a horizontal surface of the bent portion 410. That is, the horizontal surface of the bent portion 410 projects towards the recess 118 of the housing 110, hence further providing an effect of reducing the size of the button structure 100.

In the embodiment in FIG. 2, each of the button shafts 210 further includes a fastening furrow 240 for fastening with the fastening hole 450. The fastening furrows 240 are provided at positions further away from the button cap 200 relative to positions of the encircling channels 220. Substantially, each of the flat portions 430 further includes a breach 452. The breaches 452 are formed at one side of the fastening holes 450, such that the breaches 452 horizontally correspond with the fastening furrows 240 and are directly fastened with the fastening furrows 240. In the embodiment, preferably, the bent portion 410 and the flat portions 430 of the fastening member 400 are an integral formed by stamping and bending. Each of the fastening holes 450 at the flat portions 430 is further provided with a plurality of elastic fastening portions 460. That is, the elastic fastening portions 460 are in a spaced and surrounding arrangement, and are disposed in protrusion at a side edge of the fastening hole 450.

The elastic fastening portions 460 are parallel to the flat portions 430, and an inner diameter formed by an outer edge of each of the elastic fastening portions 460 is usually smaller than an outer diameter of the fastening furrows 240. with gaps (not shown) between the elastic fastening portions 460 in a spaced arrangement, the elastic fastening portions 460 are elastically fastened with the fastening furrows 240. The structure of the fastening holes 450 at the two ends of the fastening member 400 is commonly referred to as an E-buckle or C-buckle structure, and provides the embodiment with effects of having a simple assembly and being time-saving.

Figure 5:
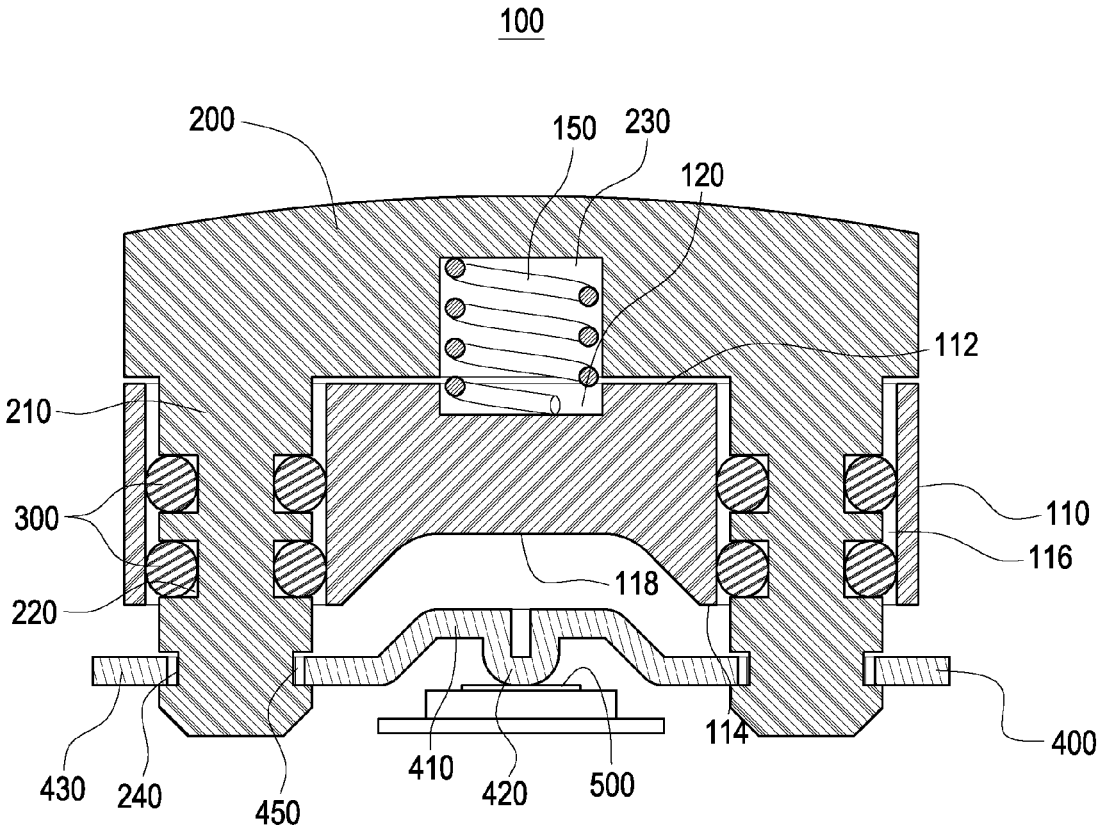
FIG. 5 is a section view of the protrusion abutted against a press switch when a button cap is pressed in the present invention.

The fastening member 400 is capable of moving with movements of the button shafts 210 of the button cap 200. As shown in FIG. 4, when the button cap 200 is pressed, the protrusion 420 drives the fastening member 400 to be abutted against the press switch 500 to activate an associated signal, as shown in FIG. 5. When the button cap 200 is released, contributed by the elastic restoring force of the elastic element 150, the button cap 200 and the two button shafts 210 are allowed to restore to original positions, hence separating the protrusion 420 of the fastening member 400 and the press switch 500.

Figure 6:
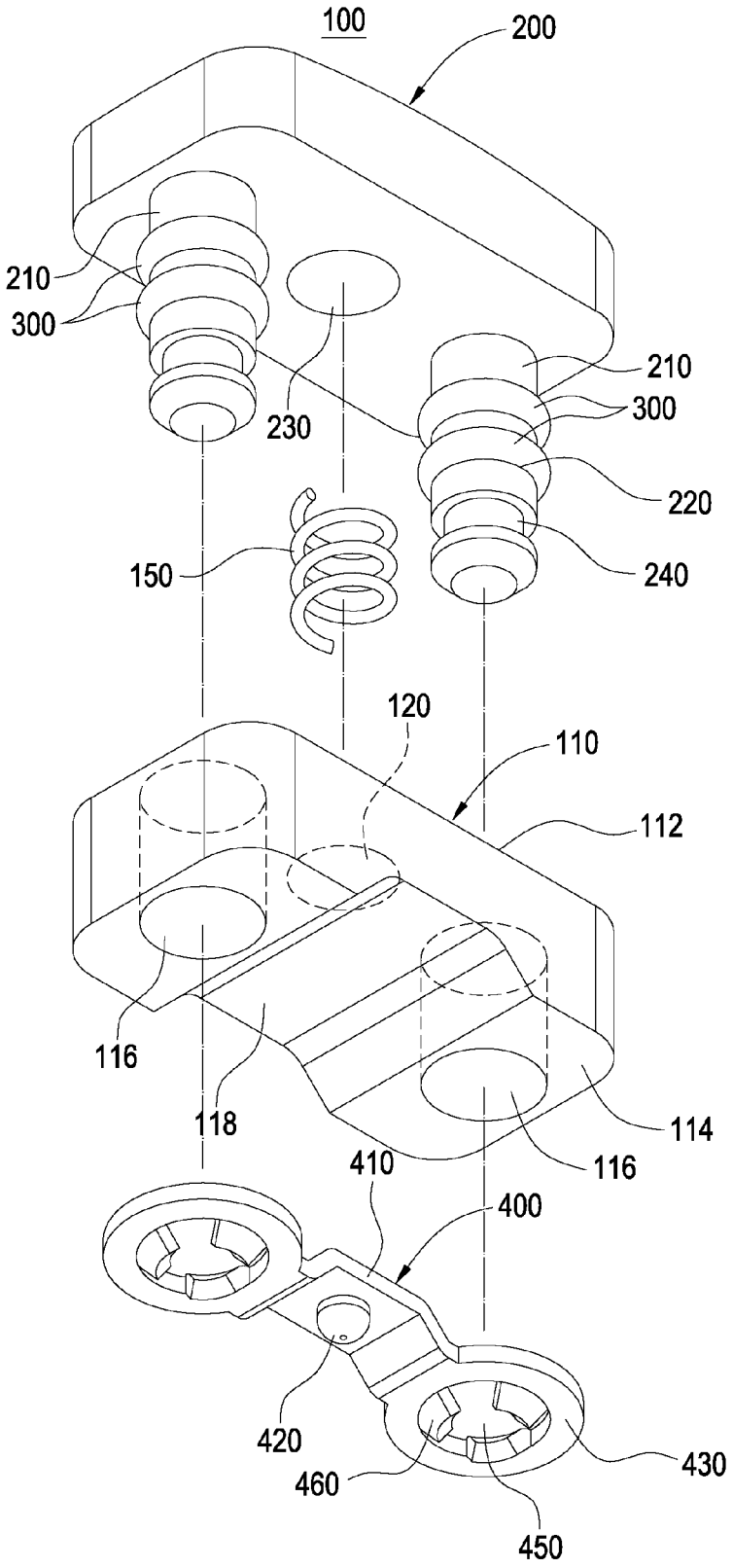
FIG. 6 is an exploded view according to a second embodiment of the present invention.
Figure 7:
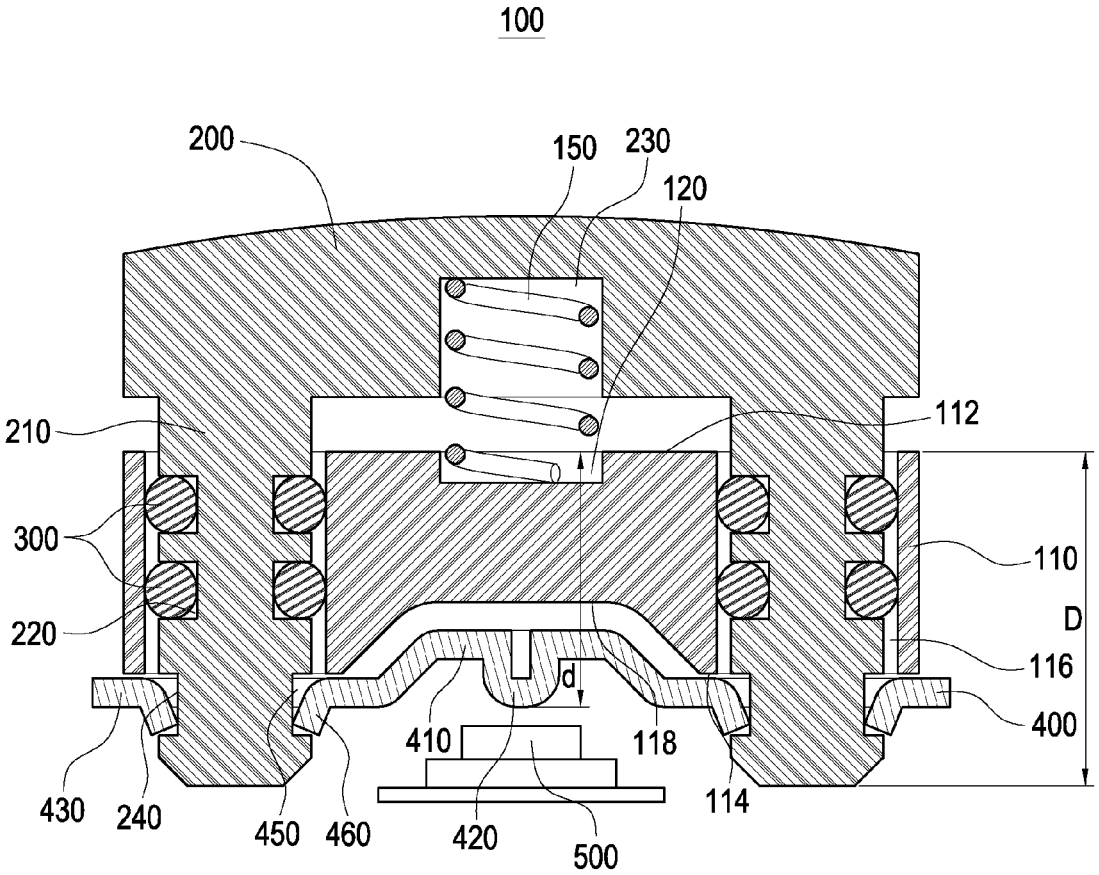
FIG. 7 is a section view according to the second embodiment of the present invention.

FIG. 6 and FIG. 7 are an exploded view and a section view according to a second embodiment of the present invention. In the embodiment, the fastening member 400 is differently structured from the previous embodiment. That is, the fastening holes 450 at the flat portions 430 of the fastening member 400 are enclosed circular holes. In other words, no breach is formed at the flat portions 430, and the fastening member 400 is directly accommodated in the fastening furrows 240 at the button shafts 210 via the fastening holes 450.

As shown in FIG. 7, each of the flat portions 430 further includes a plurality of elastic fastening portions 460 having surfaces (curved relative to one other) different from that of the flat portion 430. The elastic fastening portions 460 are in a spaced and surrounding arrangement, and are disposed in protrusion at a side edge of the fastening hole 450. As such, the fastening member 400 is assembled to the fastening furrows 240 from end portions of the button shafts 210 towards a moving direction of the button cap 200 by using the elastic deformation of the elastic fastening portions 460. Details of the structures and connection relationship of the embodiment can be referred from the description associated with the previous embodiment, and shall be omitted herein.

Figure 8:
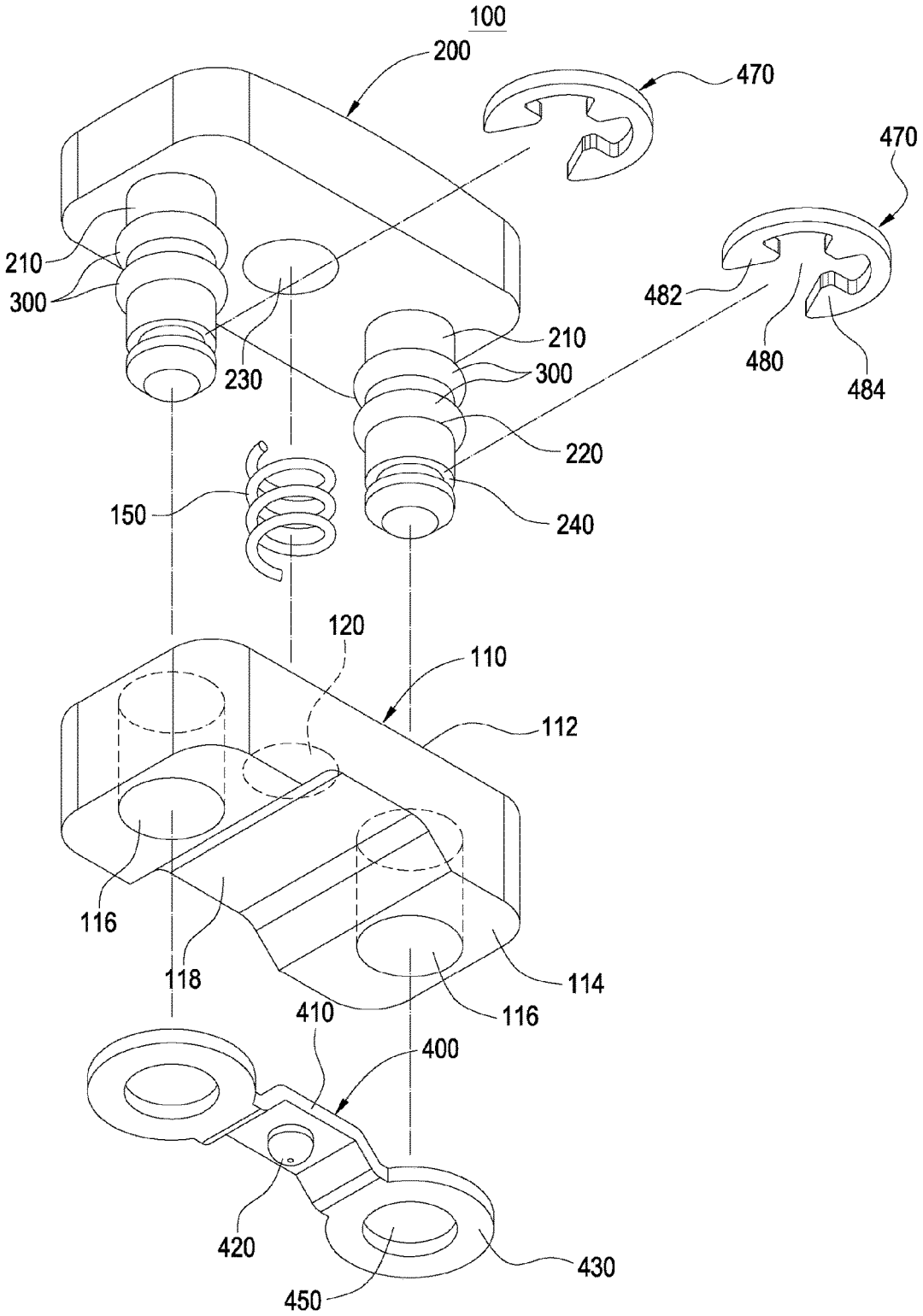
FIG. 8 is an exploded view according to a third embodiment of the present invention.
Figure 9:
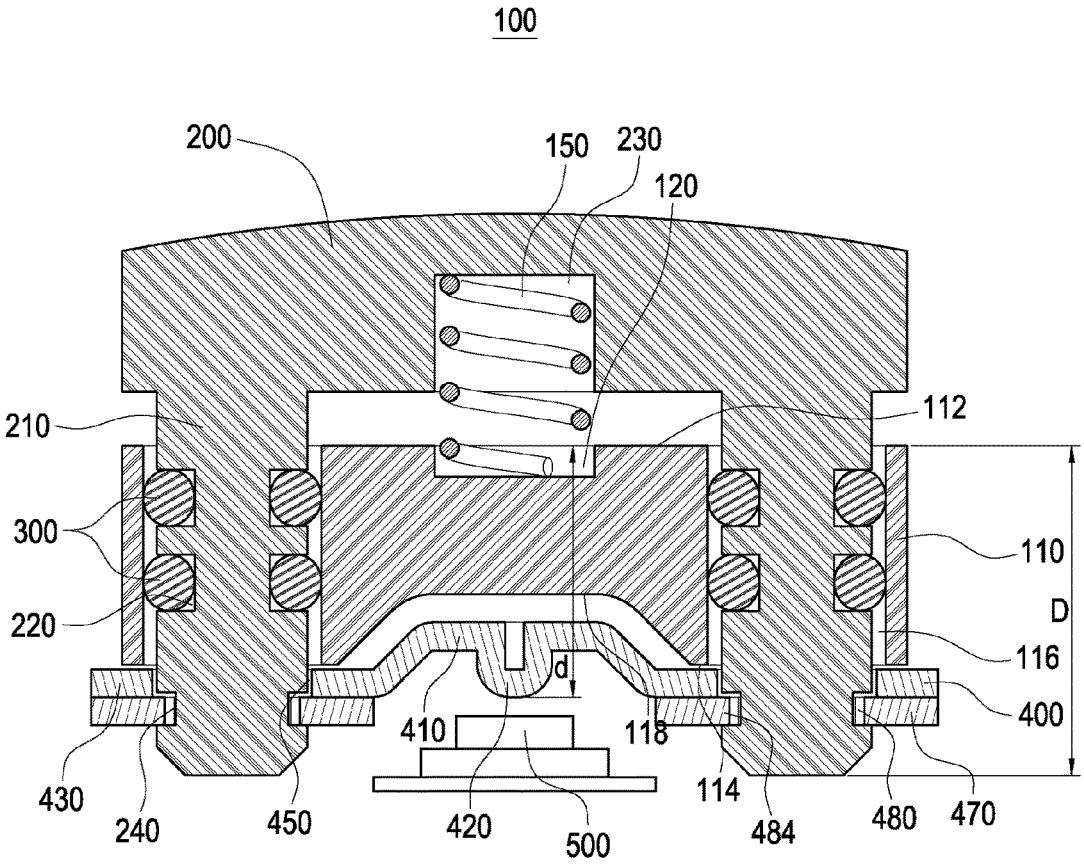
FIG. 9 is a section view according to the third embodiment of the present invention.

FIG. 8 and FIG. 9 show an exploded view and a section view according to a third embodiment of the present invention. In the embodiment, the fastening member 400 is differently structured from the two previous embodiments. Details of the structures and connection relationship can be referred from the description associated with the first embodiment, and shall be omitted herein. In this embodiment, the fastening member 400 further includes two positioning members 470 that can be disengaged from the fastening member 400. The fastening member 400 in this embodiment serves for an only purpose of electrically contacting with the press switch 500, and does not support a function of positioning the button shafts 210. As shown in FIG. 8, each of the flat portions 430 of the fastening member 400 is provided with only the fastening hole 450 as an enclosed circular hole. The two positioning members 470 provide the fastening member 400 with a positioning effect, and are usually referred to as an E buckle or a C buckle. Each of the positioning members 470 includes a positioning hole 480, a breach 482 and a plurality of elastic fastening portions 484. The breach 482 is formed at one side of the positioning hole 480 and is disposed correspondingly to the fastening furrows 240. The elastic fastening portions 484 are in a spaced and surrounding arrangement, and are disposed in protrusion at one side edge of the positioning hole 480 to elastically fasten with the fastening furrows 240, respectively.

As shown in FIG. 9, the fastening member 400 is disposed between the housing 110 and the positioning members 470, and is secured in the fastening furrows 240 of the button shafts 210 through the positioning members 470. The elastic fastening portions 484 of the positioning members 470 have the same level surface. With gaps (not shown) between the spaced elastic fastening portions 484, the fastening furrows 240 are elastically fastened to the fastening furrows 240 at the same time position the fastening member 400.

In the present invention, the groove 118 is provided at the second surface 114 of the housing 110, and the bent portion 410 of the fastening member 400 is disposed in protrusion towards the groove 118. Accordingly, compared to a conventional solution, the present invention reduces the size by 1.06 mm to further reduce the size of the button structure 100, thus yielding reduced overall size by 3.2%. Further, using the two button shafts 210 correspondingly disposed at the button cap 200, a pressing force is evenly distributed, thereby eliminating issues of wear at one side of the waterproof element caused by an unevenly distributed force and likely leakage of incoming water into the structure.

While the invention has been described in terms of what is presently considered to be the most practical and preferred embodiments, it is to be understood that the invention is only illustrative and needs not to be limited to the above embodiments. It should be noted that, equivalent variations and replacements made to the embodiments are to be encompassed within the scope of the present invention. Therefore, the scope of the present invention is to be accorded with the appended claims.

What is claimed is:

1. A waterproof button structure for collaborating with a press switch, the waterproof button structure comprising:

a housing, having a first surface facing a button cap and a second surface facing away from the button cap, formed with a pair of through holes and a groove, the groove disposed at the second surface and formed only between the pair of through holes;

the button cap, capable of moving along a normal direction of the first surface of the housing, comprising a pair of button shafts respectively inserted in the pair of through holes;

a plurality of waterproof elements, disposed between the button shafts and the through holes; and a fastening member, assembled to the pair of button shafts and disposed correspondingly to the second surface, comprising a bent portion, the bent portion disposed protrudingly towards the groove, wherein the bent portion comprises a protrusion, and when the button cap is pressed, the protrusion is abutted against the press switch.

2. The waterproof button structure according to claim 1, wherein a protruding height of the protrusion from the first surface towards the press switch is smaller than a height of the button shafts from the first surface towards the press switch.

3. The waterproof button structure according to claim 1, wherein each of the button shafts further comprises a plurality of encircling channels for disposing the waterproof elements.

4. The waterproof button structure according to claim 3, wherein each of the waterproof elements is a waterproof rubber ring, and has an outer diameter greater than or equal to an inner diameter of the through holes.

5. The waterproof button structure according to claim 3, wherein each of the waterproof elements is a waterproof plastic strip.

6. The waterproof button structure according to claim 1, further comprising an elastic element disposed between the button cap and the housing.

7. The waterproof button structure according to claim 6, wherein the button cap further comprises a first abutting recess located between the two button shafts, a second abutting recess is provided at the first surface of the housing, the second abutting recess is located between the pair of through holes and is disposed correspondingly to the first abutting recess, and two ends of the elastic element are positioned in the first abutting recess and the second abutting recess, respectively.

8. The waterproof button structure according to claim 7, wherein the elastic element is a spring.

9. The waterproof button structure according to claim 1, wherein the fastening member further comprises a flat portion and a fastening hole, the flat portion connects one of two ends of the bent portion, the fastening hole is formed in the flat portion, and each of the button shafts further comprises a fastening furrow to be fastened with the fastening hole.

10. The waterproof button structure according to claim 9, wherein the flat portion further comprises a breach, the breach is formed at one side of the fastening hole, and the fastening furrow is clasped into the fastening hole directly through the breach.

11. The waterproof button structure according to claim 9, wherein a horizontal plane of the flat portion is different from a horizontal plane of the bent portion.

12. The waterproof button structure according to claim 9, wherein the flat portion further comprises a plurality of elastic fastening portions, and the elastic fastening portions are in a spaced and surrounding arrangement, and are disposed in protrusion at a side edge of the fastening hole.

13. The waterproof button structure according to claim 9, wherein the fastening member further comprises two positioning members, and each of the positioning members is provided with a positioning hole, a breach and a plurality of elastic fastening portions.

14. The waterproof button structure according to claim 13, wherein the breach is formed at one side of the positioning hole and is disposed correspondingly to the fastening furrow, and the elastic fastening portions are in a spaced and surrounding arrangement and are disposed in protrusion at a side edge of the positioning hole.

15. The waterproof button structure according to claim 13, wherein the fastening member is disposed between the housing and the positioning members.

* * * * *